US005722166A

United States Patent [19]

Voswinkel

[11] Patent Number: 5,722,166

[45] Date of Patent: Mar. 3, 1998

[54] PROCESS FOR MANUFACTURING A SHAPED PART CONSISTING OF DIFFERENT MATERIALS

[76] Inventor: Armin Voswinkel, Waldstrasse 2, D-86462, Langweid/Foret, Germany

[21] Appl. No.: 514,829

[22] Filed: Aug. 14, 1995

[30] Foreign Application Priority Data

Aug. 12, 1994 [DE] Germany ..... 44 28 562.0

[51] Int. Cl.[6] ..... B29C 33/40; B29C 37/02; B21F 43/00

[52] U.S. Cl. ..... 29/896.4; 264/138; 264/220; 264/221; 264/227

[58] Field of Search ..... 29/896.4, 896.43; 264/60, 138, 220, 221, 225–227

[56] References Cited

U.S. PATENT DOCUMENTS 2,118,468 5/1938 Jungersen ..... 29/896.4

3,964,284 6/1976 Boultinghouse ..... 29/896.4

4,254,544 3/1981 Barker ..... 29/896.43

*Primary Examiner*—P. W. Echols

*Attorney, Agent, or Firm*—Jones, Tullar & Cooper, P.C.

[57] ABSTRACT

In the manufacture of a shaped part, which consists of different materials and includes a support body and a cover, which covers the support body at least in part, economical and rational production can be achieved in which the following process steps are provided: at least one model version of the shaped part in the original size is made out of shapeable material, a cover mold is made by using a model version in its original size, a model version of the original size is cut down to the contour of the support body and is thus used as a model for producing a support body mold, by means of which the support body is produced, and the cover mold is filled with a filling, which constitutes the cover and can be subsequently solidified, into which the previously made support body is embedded, and which is then solidified.

14 Claims, 1 Drawing Sheet

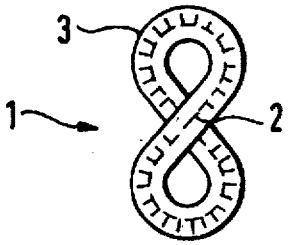
FIG.1
FIG.2
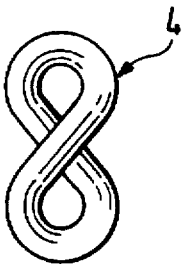
FIG.3
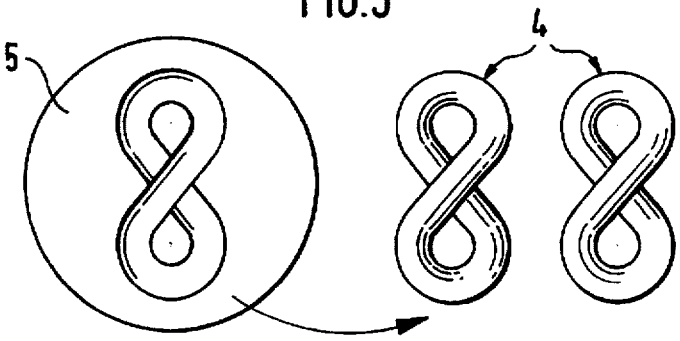
FIG.6
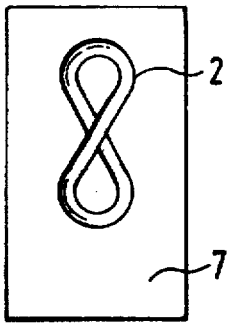
FIG.5
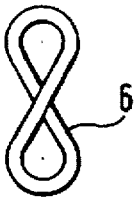
FIG.4
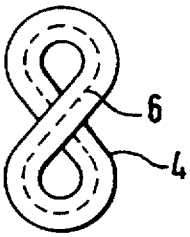
FIG.8
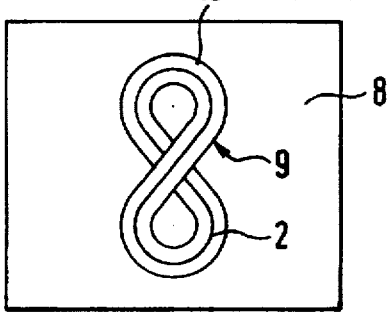
FIG.7
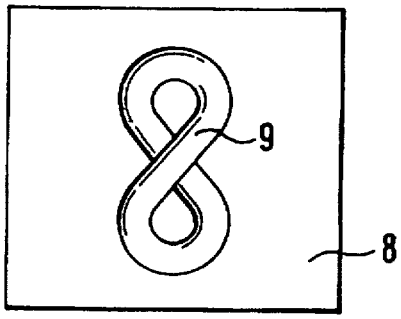

PROCESS FOR MANUFACTURING A SHAPED PART CONSISTING OF DIFFERENT MATERIALS

FIELD OF THE INVENTION

The present invention relates to a process for manufacturing a shaped part consisting of different materials, particularly for an ornamental piece.

BACKGROUND OF THE INVENTION

Up to now, individual pieces, which are freely shaped out of final material have been made almost exclusively in connection with the manufacture of ornamental pieces. The final material comprises different materials. This requires the use of materials which allow this kind of working. Moreover, practically every piece must be individually shaped, which results in a high expenditure.

SUMMARY OF THE INVENTION

With this in mind, it is an object of the present invention to simplify the production of shaped parts of the type mentioned.

This object is attained by producing a shaped part which includes a support body and a cover which is placed over at least a part of the support body, wherein the following process steps are provided:

- At least one model version of the shaped part in its original size is made out of shapeable material,
- a cover mold is made by using a model version of the original size,
- a model version of the original size is cut down to the contour of the support body and is thus used as a model for producing a support body mold, by means of which the support body is made,
- the cover mold is filled with a filling material, which constitutes the cover and can be subsequently solidified, into which the previously produced support body is embedded and which is then solidified.

These measures assure that the modeling work required can be limited to one model version. With the help of casting molds, which are derived from the model version, which is modeled once, the end product can be manufactured in virtually any desired number of pieces until the service life of the casting molds is exhausted, which results in high economy.

A further advantage of the measures according to the present invention can be seen in that the support body can be embedded in the material which constitutes the cover, so that it remains invisible and the visible surface is constituted exclusively by the cover. Since the support body lends the cover the required stability, materials can also be advantageously employed for the cover, which would not have the required stability without the support body, whose use, however, is very desirable for aesthetic reasons. This is true in particular for ceramic, preferably fine ceramic materials, such as porcelain, which produces a very desirable, fine, and shiny surface. Therefore, the measures according to the present invention advantageously also make possible the manufacture of ornamental porcelain parts, such as jewelry, and the like. Furthermore, the measures according to the present invention assure that the support body, as long as it is made of metal and is only partly covered, also makes possible a solder connection of the entire shape to a base, for example a large sheet metal piece or the like.

It can turn out to be particularly practical if an elastic copy is made of the first model version, which is used to make at least one other model version as a copy. These measures advantageously result in particularly high economy and reliability. Since new model versions can always be cast with the help of the mold, e.g. out of wax, these can advantageously be used in the manufacture of molds as lost models, i.e. thoroughly baked, which reliably prevents damage to the mold. Furthermore, the process of mold manufacture can be easily repeated after the service life of a mold is exhausted.

Further advantageous embodiments and practical improvements of the above measures ensue from the exemplary description below by means of the drawing.

BRIEF DESCRIPTION OF THE DRAWINGS

FIG. 1 shows a view of a shaped ornamental piece or part according to the present invention and FIGS. 2 to 8 show various stages in the manufacture of the shaped part or piece according to the present invention.

DESCRIPTION OF THE PREFERRED EMBODIMENTS

The shaped part or piece 1 in FIG. 1, consists of a or materials combination, namely of fine, ceramic material, such as porcelain, which is visible, and an inner core comprising a tough material. This core constitutes a support body 2, which is embedded in the surrounding material. The visible material constitutes a cover 3, which encloses the support body 2. The support body 2 has a configuration which is geometrically similar to the cover 3. The use of porcelain as the covering material yields a smooth, shiny surface.

The support body 2 can be covered by the cover 3, completely as in this case, or only partially. On the back side the support body 2 is at least partially open. As long as a metal, for example a precious metal in the form of gold or the like is used for the support body 2, there is the possibility of a solder connection with a base in the form of a larger sheet metal piece, etc.

The production of the above-outlined shaped part or piece 1 FIG. 1, begins with the production of a model whose outer contour corresponds to the outer contour of the desired shaped part shown in FIG. 1. A model version 4 of this kind appears in FIG. 2. The first model version 4 is modelled by hand out of a suitable, shapeable material, for example, wax. Other model versions 4 are made as copies of this first model version, as is shown on the right in FIG. 3. For this purpose, a mold 5 is produced, which consists of, for example, an elastic rubber material. By using the first model version 4, as further shown in FIG. 3, the mold 5 serves for casting further model versions 4, which consist of wax or the like. The use of an elastic rubber material to make the mold 5 makes unmolding without damage easier. The original and the copies of the model versions 4 are identical.

The model versions 4 now available are used to manufacture fireproof molds for casting the support body 2 and to fire the cover 3. The manufacture of the support body 2 is carried out in that a model version 4 is cut down to the geometrically similar contour of the support body 2, as shown in FIG. 4. The support body contour is indicated in FIG. 4 by dashed lines. The mentioned cutting of a model version 4 down to the contour of the support body 2 is achieved by material removal, for example by means of a scraper, etc.

The support body model 6 made in this manner, which is indicated in FIG. 4 by dashed lines and represented in FIG.

5, is used to produce a fireproof support body mold 7, which is seen in FIG. 6. This can comprise a material suitable for metal casting, for example, plaster. With the help of the mold 7, a plurality of support bodies 2 can be cast. As soon as the service life of the support body mold 7 is exhausted, the above described process is repeated using another model version 4. To avoid the work expenditure for cutting down another model version 4, though, the process can also be that an elastic reserve mold similar to the mold 5 is also produced from the first support body model 6 made, by means of which other support body models can be cast out of wax or the like. In the example shown, a precious metal, for example gold, can be used to form the support body 2. In any case, it should be a material to which the material that comprises the cover 3 can stick to well. When the cover is porcelain, gold is suitable for the support body material.

At the same time as the support body production, a cover mold 8, shown in FIG. 7, that is a mold, whose mold interior 9 corresponds to the outer shape of the cover 3, is produced by using another model version 4. When ceramic material is used to form the cover 3, the cover mold 8 is made of fireproof material, for example plaster, so that a firing process is possible. The mold production can be performed in such a way that the model version 4 is pressed into the wet plaster and removed after the plaster hardens. As long as the model version is a wax body, this can be easily removed by burning it out so that there is no mold damage upon removal of the model version. In this case, though, it is lost. In the present case, this has no effect since a plurality of model versions can be produced with the help of the mold 5.

The mold interior 9 of the cover mold 8 is filled with the material which constitutes the cover 3. When porcelain is used, the mold interior 9 is coated with it while it is in form of a paste. The previously made support body 2, here preferably made of metal, is pushed into this filling 10 of the mold interior 9, as shown in FIG. 8. The support body 2 is embedded to the point that only its back side remains exposed in the region of the opening cross section of the mold interior 9. Then a firing process is carried out. To do this, the cover mold 8, which is filled and provided with the support body 2, undergoes a heat treatment in a kiln, which leads to a solidification of the filling 10 and correspondingly to the formation of the cover 3. It also bonds to the support body 2, which produces an excellent adhesion of the cover 3 on the support body 2. In addition, it would be conceivable to provide the support body 2 with star-shaped protruding spikes in order to make an interlocking connection possible. After the end of the firing process, the finished shaped part 1 can be removed from the cover mold 8. As soon as its service life is exhausted, a new cover mold 8 can be produced using a model version.

In the event that there is only one model version 4, the cover mold 8 is produced first in such a way that the model version being sued is not lost. This is then cut down to produce the support body model 6. In such a case, the production of the mold 5 and the copying of the first model version is in fact no longer necessary. On the other hand, though, in this case the number of producible shapes is limited by the service life of the molds.

What is claimed is:

1. A process for manufacturing a shaped part including a support body and a cover covering at least a part of the support body, comprising the steps of:

forming a model version of the shaped part from shapeable material;

forming a cover mold from the model version of the shaped part;

forming a model of the support body using the model version of the shaped part by cutting the model version of the shaped part to the desired size; and placing the model of the support body in the cover mold and filling the cover mold with a filling material.

2. The process as defined in claim 1, wherein the model version of the shaped part is made by hand, and wherein at least one copy of the shaped part is made from the model version of the shaped part.

3. The process as defined in claim 2, further comprising the step of:

forming an elastic mold from the model version of the shaped part made by hand, said elastic mold forming at least one other model version of the shaped part.

4. The process as defined in claim 3, wherein the elastic mold comprises a rubber-like material.

5. The process as defined in claim 2, wherein the model version of the shaped part made by hand is made of wax.

6. The process as defined in claim 1, further comprising the step of:

forming a fireproof cover mold from the model version of the shaped part made by hand.

7. The process as defined in claim 1, further comprising the step of:

burning the model version of the shaped part out of the cover mold.

8. The process as defined in claim 1, wherein the model version of the support body is made of metal.

9. The process as defined in claim 8, wherein the metal is precious metal.

10. The process as defined in claim 1, wherein the cover comprises ceramic material, and further comprising the steps of:

coating the cover mold with the ceramic material while it is in the form of a paste; and firing the cover in the cover mold after the support body is embedded therein.

11. The process as defined in claim 10, wherein the ceramic material is a fine ceramic material.

12. The process as defined in claim 10, wherein porcelain is used to form the cover.

13. The process as defined in claim 1, wherein the support body is completely embedded in material forming the cover.

14. The process as defined in claim 1, wherein the shaped part comprises jewelry.

* * * * *